US008757433B2

(12) United States Patent
Machers

(10) Patent No.: US 8,757,433 B2
(45) Date of Patent: Jun. 24, 2014

(54) DISPENSER

(75) Inventor: Christian Machers, Neuss (DE)

(73) Assignee: Gastro-Cool GmbH & Co. KG, Kaarst (DE)

( * ) Notice: Subject to any disclaimer, the term of this patent is extended or adjusted under 35 U.S.C. 154(b) by 336 days.

(21) Appl. No.: 12/831,342

(22) Filed: Jul. 7, 2010

(65) Prior Publication Data

US 2011/0006074 A1 Jan. 13, 2011

(30) Foreign Application Priority Data

Jul. 7, 2009 (DE) ..... 20 2009 009 330 U
Jul. 16, 2009 (DE) ..... 20 2009 009 743 U

(51) Int. Cl.
*A47F 1/08* (2006.01)
*A47F 1/12* (2006.01)
*A47F 7/28* (2006.01)

(52) U.S. Cl.
USPC ..... 221/92; 221/301; 221/289; 221/299; 221/290; 221/194; 221/150 R; 221/283; 221/261; 221/285; 221/255; 221/268; 221/97; 221/202; 211/59.2; 312/72; 62/277; 62/378; 62/457.4; 62/3.64

(58) Field of Classification Search
CPC ..... A47F 1/08; A47F 1/085; A47F 1/12; A47F 7/28
USPC ..... 62/457.4, 3.64, 277, 378; 211/59.2; 312/72; 221/92, 301, 289, 299, 290, 221/194, 150 R, 283, 261, 285, 255, 268, 221/97, 202; 193/38, 27
See application file for complete search history.

(56) References Cited

U.S. PATENT DOCUMENTS

| | | | | |
|---|---|---|---|---|
| 2,376,682 | A | 5/1945 | Gerlich | |
| 2,711,241 | A * | 6/1955 | Abrahamsen | 193/38 |
| 4,132,214 | A * | 1/1979 | Schnurr et al. | 124/1 |
| 4,235,351 | A * | 11/1980 | Kolbl et al. | 221/92 |
| 4,238,051 | A * | 12/1980 | Sherman | 221/205 |
| 4,405,059 | A * | 9/1983 | Kull | 221/129 |
| 4,729,480 | A * | 3/1988 | Groover et al. | 211/59.2 |
| 5,356,033 | A * | 10/1994 | Delaney | 221/194 |
| 6,173,582 | B1 * | 1/2001 | Hixson | 62/457.4 |
| 6,206,237 | B1 * | 3/2001 | Dillon et al. | 221/289 |
| 6,234,345 | B1 * | 5/2001 | Minh et al. | 221/124 |
| 6,862,896 | B1 * | 3/2005 | Seidl | 62/457.4 |
| 8,028,855 | B2 * | 10/2011 | White et al. | 221/191 |

FOREIGN PATENT DOCUMENTS

| | | |
|---|---|---|
| DE | 27 33 968 | 2/1979 |
| DE | 79 11 996 | 7/1979 |

* cited by examiner

*Primary Examiner* — Gene O. Crawford
*Assistant Examiner* — Rakesh Kumar
(74) *Attorney, Agent, or Firm* — Berenato & White, LLC

(57) ABSTRACT

A dispenser automatically dispenses beverage cans. A housing has a conveyor along which cans are conveyed by gravity to a removal opening. A dispensing flap is on the removal opening and can be pivoted between a closed position, in which it prevents the removal of products through the removal opening, and a removal position. The dispensing flap has two trough-shaped receptacles lying at right angles to the conveyor section for one can, and is pivotal such that in the closed position a can is conveyed from the conveyor section into the first receptacle positioned to the inside of the housing, removal of the can from the first receptacle being prevented. In the removal position the can rolls from the first receptacle into the second receptacle, at the same time a new can is prevented from being conveyed from the conveyor into the first receptacle.

9 Claims, 4 Drawing Sheets

DISPENSER

CROSS-REFERENCE TO RELATED APPLICATIONS AND CLAIM TO PRIORITY

This application is related to utility model application number 20 2009 009 330.1, filed Jul. 7, 2009 and utility model application number 20 2009 009 743.9 filed Jul. 16, 2009, both in the Federal Republic of Germany, the disclosures of which are incorporated herein by reference and to which priority is claimed.

FIELD OF THE INVENTION

The present invention relates to a can dispenser for automatically dispensing can-shaped products, in particular cans of drinks, comprising a housing in which a conveyor section is formed along which can-shaped products are conveyed by the force of gravity to a removal opening of the housing, on the removal opening a dispensing flap being provided which can be moved pivotably between a closed position, in which it prevents the removal of products through the removal opening, and a removal position, the dispensing flap being designed in order to accommodate a can from the conveyor section in its closed position.

BACKGROUND OF THE INVENTION

Can dispensers of the type described above are used in particular as beverage vending machines, and are known in various embodiments. U.S. Pat. No. 6,173,582 B1 discloses, for example, a beverage vending machine in which a conveyor section is formed along which cans of drink roll along from a filling opening to a removal opening due to the force of gravity, and in so doing are cooled. In the region of the removal opening a dispensing flap is provided which can pivot between a closed position, in which it closes the removal opening, and a dispensing position, in which it is possible to remove a can from the can dispenser. The dispensing flap has a receptacle here on its inner side in which the lowermost can rolls in the conveyor section when the dispensing flap is in its closed position. If the flap is opened, the receptacle pivots with it such that the can lying in it can be removed.

The manipulation of the known can dispenser is partially considered to be laborious. This is because when the dispensing flap is open, the can lying on it is still partially within the can dispenser, and so can only be removed with difficulty. Filling the appliance with new cans is also complex because first of all a flap closing the filling opening has to be opened, and then the cans must be placed individually into the can dispenser.

SUMMARY OF THE INVENTION

It is therefore the object of the invention to design a can dispenser of the type specified at the start such that it is easy to operate.

This object is achieved according to the invention in that the dispensing flap has two trough-shaped receptacles lying at right angles to the conveyor section for one can respectively, and is designed and/or pivotably mounted such that in the closed position a can is conveyed from the conveyor section into the first receptacle positioned to the inside of the housing, removal of the can from the first receptacle being prevented, however, and in the removal position the can rolls from the first receptacle into the second receptacle, at the same time a new can being prevented from being conveyed from the conveyor section into the first receptacle.

According to the invention the dispensing plate has two trough-shaped receptacles, namely in the conventional way a first receptacle into which a can from the conveyor section automatically rolls if the dispensing flap is closed, and a second receptacle into which the can rolls if the removal flap is opened. In other words, upon opening the dispensing flap a can positioned in the first receptacle rolls outwards into the second receptacle so that it can be grasped freely, and so be easily removed.

In one embodiment of the invention provision is made such that between the two trough-shaped receptacles a holding projection is provided which is designed such that removal of a can lying in the first receptacle in the closed position of the dispensing flap is prevented, the can is conveyed, however, by the force of gravity, from the first receptacle into the second receptacle if the dispensing flap is pivoted into the removal position. In a way known in its own right, provision can be made such that on the end region of the dispensing flap facing towards the housing interior a blocking lug is provided which, in the dispensing position of the dispensing flap, projects into the conveyor section such that a can is prevented from rolling from the conveyor section into the first receptacle of the dispensing flap.

Moreover, the second receptacle can advantageously be designed such that in the dispensing position of the dispensing flap a can is prevented from rolling out of the second receptacle due to the force of gravity. In particular, a holding projection can be formed on the edge region of the second receptacle facing away from the housing which holds a can in the second receptacle when the dispensing flap is open. This is particularly necessary with embodiments in which the dispensing flap needs to be pivoted down over the horizontal.

Furthermore, the invention provides a can dispenser for automatically dispensing can-shaped products, in particular cans of beverage, comprising a housing in which a conveyor section is formed along which can-shaped products are conveyed by the force of gravity, in the region of the upper side of the housing a filling opening being provided through which the can-shaped products can be introduced into the housing, and which is characterised in that a chute formed on the upper side of the housing is assigned to the filling opening on which a can can roll to the filling opening.

The filling of the can dispenser is simplified by the chute. This is particularly the case if a number of cans can be placed on the chute at the same time.

According to a preferred embodiment, in the region of the filling opening a closing flap is provided which is held pivotably on the end on the filling opening side of the chute, and can be pivoted down out of a closing position, in which it at least partially closes the filling opening, and is held by elastic resetting means, against the resetting force of the elastic resetting means, into an open position in which it at least substantially spans the space between the chute and the conveyor section like a bridge.

Guide surfaces can be provided here on both sides of the chute for the can-shaped products.

Moreover, in a way known in its own right the can dispenser can have a cooling device in order to cool the cans within the housing.

BRIEF DESCRIPTION OF THE DRAWINGS

With regard to further advantageous embodiments of the invention reference is made to the sub-claims and to the following description of an exemplary embodiment with reference to the attached drawings. The drawings show as follows:

DETAILED DESCRIPTION OF THE PREFERRED EMBODIMENT(S)

Figure 1:
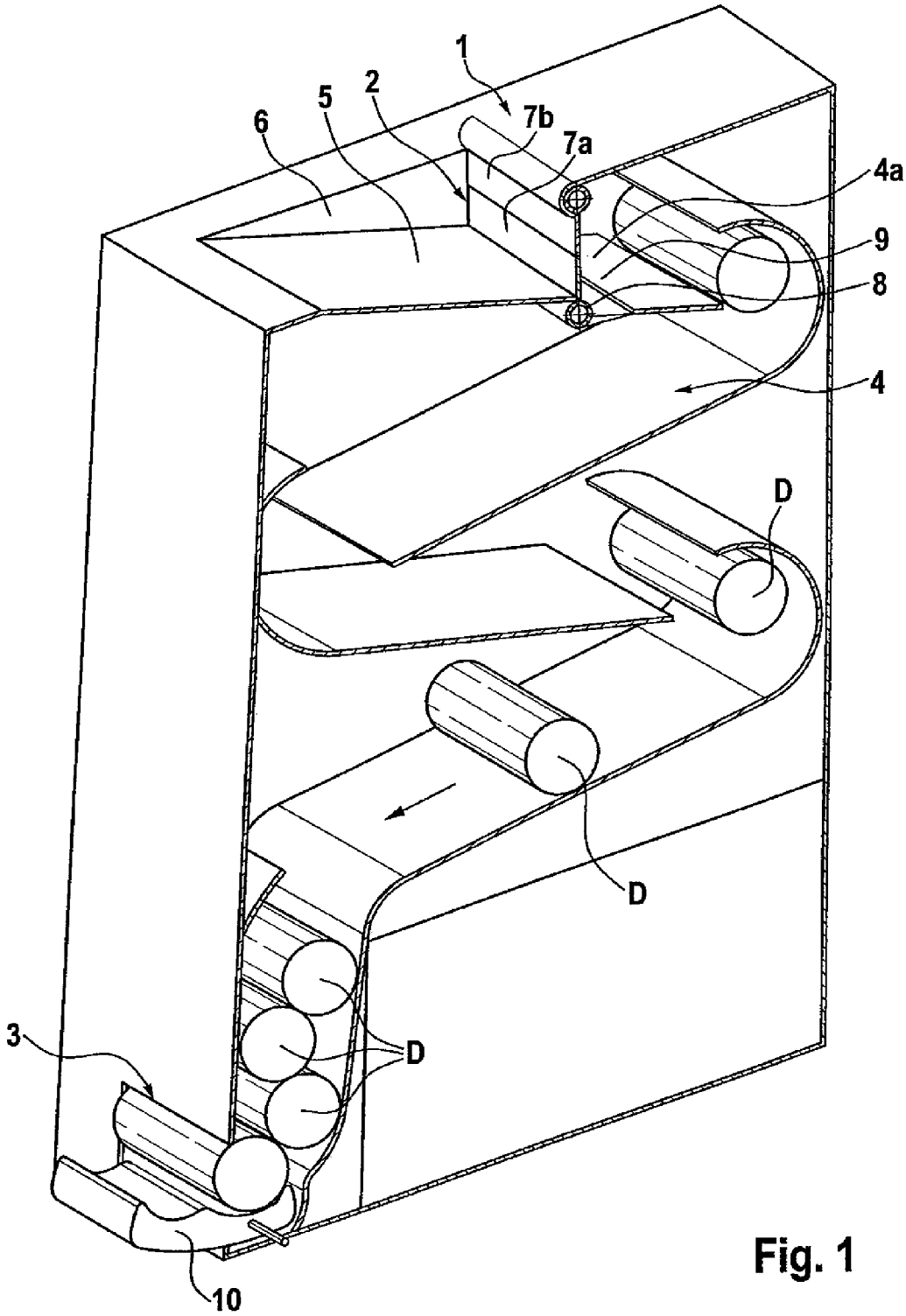
FIG. 1 in a diagrammatic view, an embodiment of a can dispenser according to the invention, FIG. 2 the can dispenser from FIG. 1 when filling with a can, FIG. 3 in a diagrammatic partial sectional view, the lower region of the can dispenser on the removal opening, FIG. 4 a top view of a dispensing flap for the can dispenser, FIG. 5 the dispensing flap in a section along line V-V of FIG. 4, and FIG. 6 a front view of the dispensing flap.

In the drawings a can dispenser according to the present invention is shown. This is a beverage vending machine for cans of a beverage with integrated cooling. The can dispenser comprises a housing 1 which in the region of its housing upper side has a filling opening 2 and on its front side on the lower end region of the housing 1 a removal opening 3. Between the filling opening 2 and the removal opening 3 a conveyor section 4 is provided which extends between the filling opening 2 and the removal opening 3, and along which cans of drink roll purely due to the effect of the force of gravity from the filling opening 2 to the removal opening 3. The conveyor section 4 is formed by a structure of guide tracks which are not shown in detail.

Figure 2:
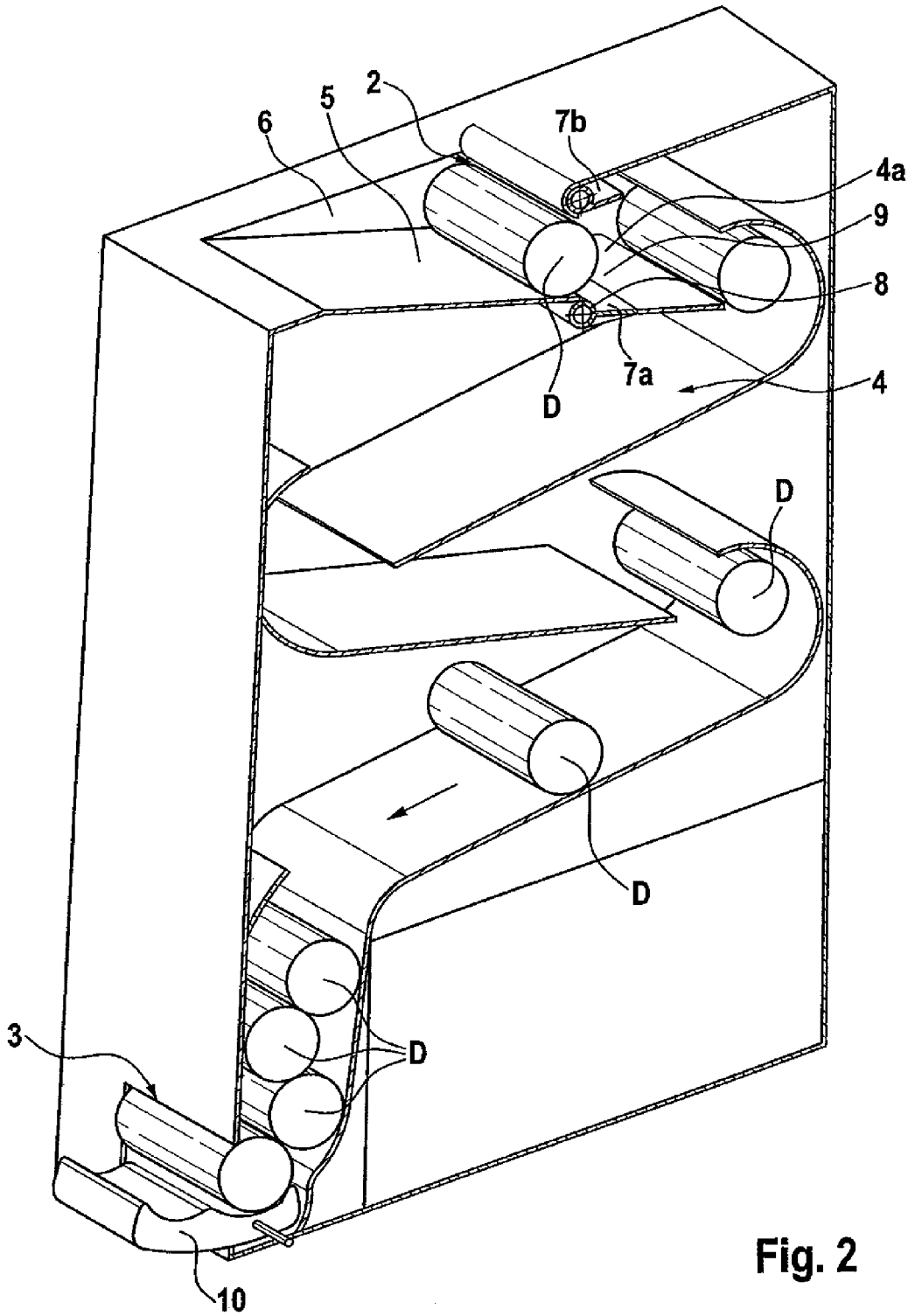

As can be seen easily in FIGS. 1 and 2, in the upper side of the housing an indentation is provided in which is formed a chute 5 which extends from the upper side of the housing to the lower end of the filling opening 2 which is aligned vertically here and serves to simplify the filling of the dispenser with cans D. The cans D only need to be placed on the chute 5, and then roll automatically due to the force of gravity to the filling opening 2, tilting being prevented by the walls 6 delimiting the chute to the side.

The filling opening 2 is closed by two closing flaps 7*a*, 7*b* in order to prevent dirt from entering into the housing interior. The lower closing flap 7*a* is held pivotably about a horizontal axis on its lower edge on the end of the chute 5 on the filling opening side, and can be pivoted down out of the closed position shown in FIG. 1, in which it is held by an elastic resetting means in the form of a spiral spring 8, against the resetting force of the spiral spring 8, into the open position shown in FIG. 2 in which it substantially spans the space 9 between the chute 5 and the conveyor section 4 like a bridge. In the same way the upper closing flap 7*b* is held pivotably about a horizontal on its upper edge region, it being possible to pivot it up from the closed position shown in FIG. 1, in which it is held by resetting means (not shown), against the resetting force of these resetting means, into the open position shown in FIG. 2. The elasticity of the resetting means 8 is chosen here such that the closing flaps 7*a*, 7*b* are automatically opened by the impulse of a can D when the latter rolls down the chute 5, and are then automatically moved back into their closed position.

Figure 3:
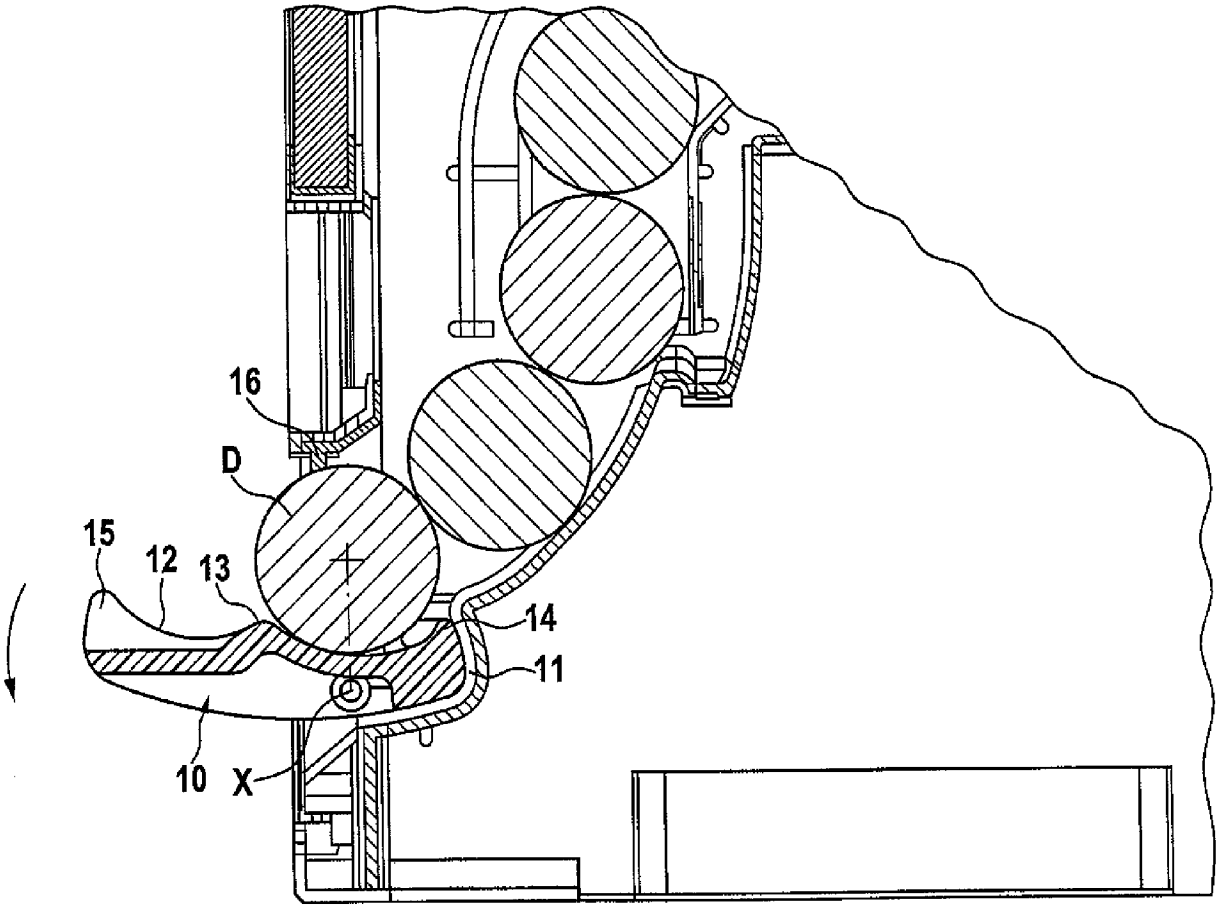
Figure 5:
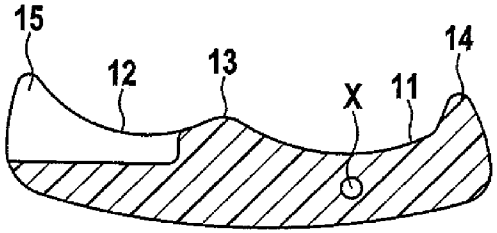
Figure 4:
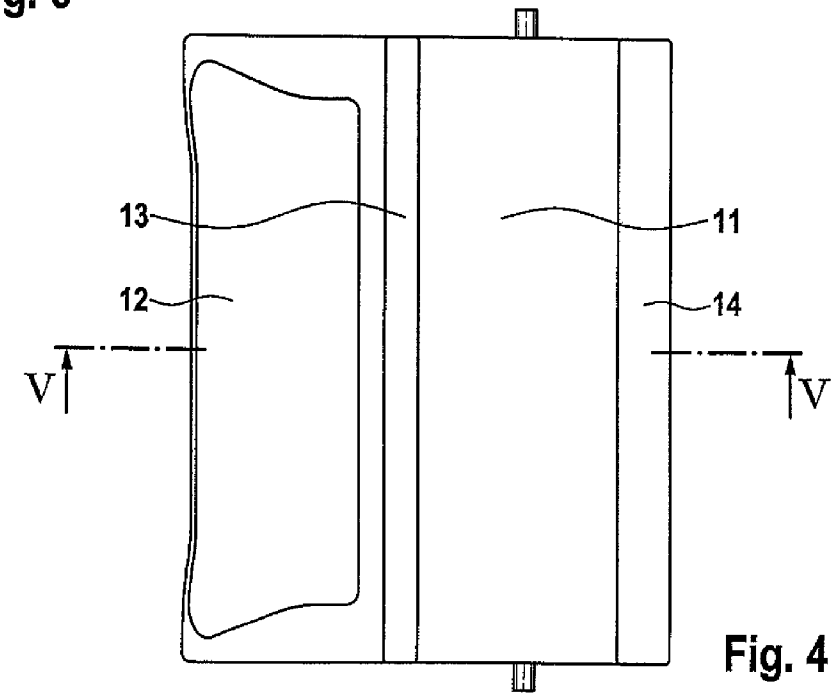
Figure 6:
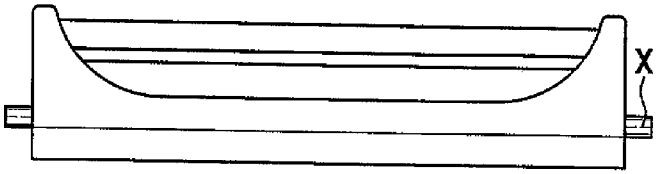

In the region of the removal opening 3 a dispensing flap 10 is provided which can move pivotably between a closed position, in which it prevents the removal of products through the removal opening 3, and a removal position. The dispensing flap 10 extends over the whole width of the removal opening 3 on the lower end of the latter, it being pivotable like a seesaw about a horizontal axis X which extends at right angles to the conveyor section 4 and the removal opening 3. It is not shown that the dispensing flap 10 is pushed by elastic resetting means into the closed position shown in FIG. 3.

The dispensing flap 10 has two trough-shaped receptacles 11, 12 lying at right angles to the conveyor section 4 for one respective can D, the first receptacle 11 lying to the inside of the housing being positioned such that a can D lying on it in the closed position of the dispensing flap 10 lies approximately centrally over the pivot axis X and in the region of the receptacle opening 3.

Between the two trough-shaped receptacles 11, 12 a holding projection 13 is provided. The latter is designed such that, together with a holding lug 16 which projects from above into the region of the removal opening 3, it prevents the removal of a can 10 lying in the first receptacle 11 if the dispensing flap 10 is located in the closed position shown in FIG. 3. On the other hand, the holding projection 13 is rounded off such that the can D rolls due to the force of gravity from the first receptacle 11 into the second receptacle 12 if the end of the dispensing flap 10 facing away from the housing 1 is pressed down, and so the dispensing flap 10 is pivoted into its removal position in the anti-clockwise direction of FIG. 1.

In order to prevent, in the removal position, a can D from rolling out of the conveyor section 4 into the first receptacle 11 of the dispensing flap 10, on the end region of the dispensing flap 10 facing towards the housing interior a blocking lug 14 is provided which in the dispensing position of the dispensing flap 10 projects into the conveyor section 4.

A similar holding projection 15 is provided on the end region of the second receptacle 12 facing away from the housing 1 in order, in the dispensing position of the dispensing flap, to prevent a can D from rolling out of the second receptacle 12 due to the force of gravity.

I claim:

1. A can dispenser for automatically dispensing, comprising a housing (1) including:

a conveyor section (4) for conveying sequentially therealong a plurality of cans by the force of gravity;

a removal opening (3) having an operably associated dispensing flap (10) pivotably movable about a horizontal axis (X) extending at right angles to the conveyor section (4) and the removal opening (3) between a closed position, in which the dispensing flap (10) prevents the removal of a first can through the removal opening (3), and a removal position;

the dispensing flap (10) being formed in order to accommodate the first can from the conveyor section (4) in the closed position thereof;

the dispensing flap (10) having first and second trough-shaped receptacles (11, 12) and a holding projection (13) separating the first and second trough-shaped receptacles (11, 12), each of the receptacles (11, 12) configured to accommodate one of the cans;

the dispensing flap (10) being pivotably mounted such that in the closed position the first can being conveyed from the conveyor section (4) into the first receptacle (11) positioned to the inside of the housing and removal of the first can from the first receptacle (11) being prevented, and in the removal position the dispensing flap allows the first can being rolled from the first receptacle (11) into the second receptacle (12) while a second can is prevented from being conveyed from the conveyor section (4) into the first receptacle (11);

the second receptacle (12) formed such that in the removal position of the dispensing flap (10) the first can is prevented from rolling from the second receptacle (12) due to the force of gravity;

the holding projection (13) provided such that removal of the first can lying in the first receptacle (11) in the closed position of the dispensing flap (10) is prevented, and the first can is conveyed by the force of gravity from the first receptacle (11) into the second receptacle (12) when the dispensing flap (10) is in the removal position;

the filling opening (2) provided with an upper closing flap (7*a*) and a lower closing flap (7*b*) held pivotably on an end of the chute (5) adjacent to the filling opening and pivotable between a closed position, in which the upper and lower closing flaps (7*a*), (7*b*) at least partially close the filling opening (2) and are held in the closed position by elastic resetting means (8) against a resetting force of the elastic resetting means (8), and an open position in which the upper and lower closing flaps (7*a*), (7*b*) at least substantially span a space (9) between the chute (5) and the conveyor section (4);

each of the cans positioned on the chute (5) rolling down the chute (5) to enter the filling opening (2) after the upper and lower closing flaps (7*a*), (7*b*).

2. The can dispenser according to claim 1, wherein on an end region of the dispensing flap (10) facing towards an interior of the housing a blocking lug (14) is provided which, in the removal position of the dispensing flap (10), projects into the conveyor section (4) such that the second can is prevented from rolling from the conveyor section (4) into the first receptacle (11) of the dispensing flap.

3. The can dispenser according to claim 2, wherein a pivot axis (X) of the dispensing flap (10) lies beneath the first receptacle (11) approximately centrally thereof.

4. The can dispenser according to claim 1, further comprising elastic resetting means biasing the dispensing flap into the closed position thereof; wherein an end of the dispensing flap extends out of the housing in the closed position thereof and is pivoted into the removal position thereof when pressed down.

5. The can dispenser according to claim 1, wherein a pivot axis (X) of the dispensing flap (10) lies beneath the first receptacle (11) approximately centrally thereof.

6. A can dispenser for automatically dispensing cans, comprising a housing (1) including:

a conveyor section (4) for conveying sequentially therealong a plurality of cans by a force of gravity;

a removal opening (3) having an operably associated dispensing flap (10) pivotably movable about a horizontal axis (X) extending at right angles to the conveyor section (4) and the removal opening (3) between a closed position, in which the dispensing flap (10) prevents the removal of a first can through the removal opening (3), and a removal position;

the dispensing flap (10) being formed in order to accommodate the first can from the conveyor section (4) in the closed position thereof;

the dispensing flap (10) having first and second trough-shaped receptacles (11, 12), each of the receptacles (11, 12) configured to accommodate one of the cans;

the dispensing flap (10) being pivotably mounted such that in the closed position the first can being conveyed from the conveyor section (4) into the first receptacle (11) positioned to the inside of the housing and removal of the first can from the first receptacle (11) being prevented, and in the removal position the dispensing flap allows the first can being rolled from the first receptacle (11) into the second receptacle (12) while a second can is prevented from being conveyed from the conveyor section (4) into the first receptacle (11);

an upper side of the housing being provided with a filling opening (2) through which the first and second cans can be introduced into the housing (1), and a chute (5) being formed on the upper side of the housing adjacent to the filling opening (2) on which the first and second cans can roll to the filling opening (2);

the filling opening (2) being provided with an upper closing flap (7*a*) and a lower closing flap (7*b*) held pivotably on an end of the chute (5) adjacent to the filling opening and pivotable between a closed position, in which the upper and lower closing flaps (7*a*), (7*b*) at least partially close the filling opening (2) and are held in the closed position by elastic resetting means (8) against a resetting force of the elastic resetting means (8), and an open position in which the upper and lower closing flaps (7*a*), (7*b*) at least substantially span a space (9) between the chute (5) and the conveyor section (4);

each of the cans positioned on the chute (5) rolling down the chute (5) to enter the filling opening (2) after the upper and lower closing flaps (7*a*), (7*b*).

7. The can dispenser according to claim 6, wherein guide surfaces (6) are provided on both sides of the chute (5) for the first and second cans.

8. The can dispenser according to claim 6, wherein a cooling device is provided in order to cool the first and second cans within the housing (1).

9. The can dispenser according to claim 6, further comprising elastic resetting means biasing the dispensing flap into the closed position thereof; wherein an end of the dispensing flap extends out of the housing in the closed position thereof and is pivoted into the removal position thereof when pressed down.

* * * * *